US006070271A

United States Patent [19]

Williams

[11] Patent Number: 6,070,271

[45] Date of Patent: Jun. 6, 2000

[54] PROTECTIVE HELMET

[76] Inventor: Gilbert J. Williams, 340 Bowen Ave., Aptos, Calif. 95003

[21] Appl. No.: 08/687,805

[22] Filed: Jul. 26, 1996

[51] Int. Cl.[7] ..... A42B 3/00

[52] U.S. Cl. ..... 2/412; 2/425

[58] Field of Search ..... 2/410, 411, 412, 2/414, 424, 425

[56] References Cited

U.S. PATENT DOCUMENTS

| | | | |
|---|---|---|---|
| 1,080,690 | 12/1913 | Hipkiss | 2/412 |
| 1,483,881 | 2/1924 | Hart | 2/412 |
| 3,859,666 | 1/1975 | Marietta et al. | 2/412 |
| 3,994,022 | 11/1976 | Villari et al. | 2/413 |
| 4,075,717 | 2/1978 | Lemelson | 2/412 |
| 4,446,576 | 5/1984 | Hisataka | 2/425 |
| 4,566,137 | 1/1986 | Gooding | 2/413 |
| 4,627,114 | 12/1986 | Mitchell | 2/414 |
| 4,710,984 | 12/1987 | Asper et al. | 2/412 |
| 4,996,724 | 3/1991 | Dextrase | 2/411 |
| 5,056,162 | 10/1991 | Tirums | 2/412 |
| 5,231,703 | 8/1993 | Garneau | 2/414 |
| 5,271,103 | 12/1993 | Darnell | 2/418 |
| 5,309,576 | 5/1994 | Broersma | 2/412 |
| 5,343,569 | 9/1994 | Asare et al. | 2/412 |
| 5,351,342 | 10/1994 | Garneau | 2/414 |
| 5,619,756 | 4/1997 | Garneau | 2/425 |
| 5,669,079 | 9/1997 | Morgan | 2/414 |

FOREIGN PATENT DOCUMENTS

| | | | |
|---|---|---|---|
| 346608 | 12/1989 | European Pat. Off. | 2/411 |
| 571065 | 11/1993 | European Pat. Off. | 2/411 |
| 84/01697 | 5/1984 | WIPO | 2/411 |

OTHER PUBLICATIONS

Mills and Hwang, "The Multiple–Impact Performance of High–Density Polyethylene Foam", *Cellular Polymers*, 1989, p. 259–276.

Loverage and Mills, "The Mechanism of the Recovery of Impacted High Density Polyethylene Foam", Date Unknown.

Zotefoams, "Introduction and Selection Guide", Date Unknown.

"Consumer Product Safety Commision", 16 CFR Part 1203 *Safety Standard for Bicycle Helmets*: Proposed Rule, Dec. 1995.

*Primary Examiner*—Michael A. Neas

*Attorney, Agent, or Firm*—James J. Leary; Leary & Associates

[57] ABSTRACT

An improved protective helmet is made of a dual density, closed-cell, polymeric foam laminate. The inner layer is a lower density (3.8 to 5 pcf), closed-cell, polymeric foam for comfort, absorbing minor impacts and distributing impact stress over a larger surface of the skull to reduce injury. The outer layer is a higher density (5 to 7.2 pcf), closed-cell, polymeric foam to absorb major impacts and add structural stability to the helmet. Ventilation holes provide airflow through the helmet. Cushioning pads may be added inside the helmet for customizing fit and improving ventilation. The preferred material for the inner and outer layers of the laminated, dual density protective helmet is a nitrogen blown, cross-linked, closed-cell, polyethylene foam. The dual density, closed-cell, polymeric foam laminate of the helmet provides improved impact attenuation. The laminate also reduces the weight of the helmet, which improves comfort and reduces neck fatigue for the wearer. The polyethylene foam laminate also exhibits improved recovery after an impact. In a second impact at the same location, the helmet has approximately 70 percent of the original impact attenuation value and after repeated impacts it has approximately 50 percent of the original impact attenuation value. The helmet also provides superior resistance to environmental factors, including moisture, heat and damage from rough handling. The manufacturing method is a low pressure compression molding process which simultaneously shapes the protective helmet and laminates the inner and outer layers of the helmet shell.

47 Claims, 10 Drawing Sheets

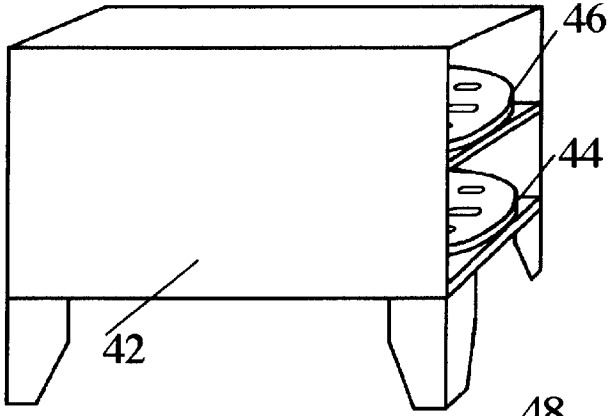
Fig. 7C
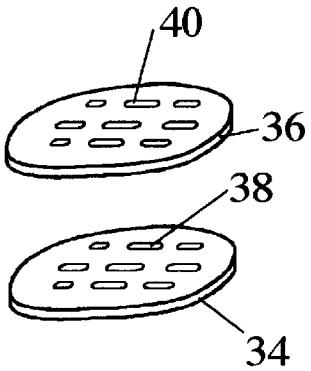
Fig. 7B
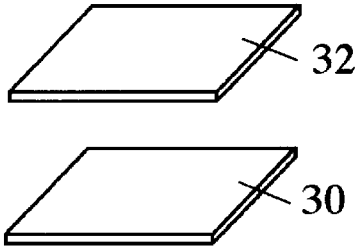
Fig. 7A
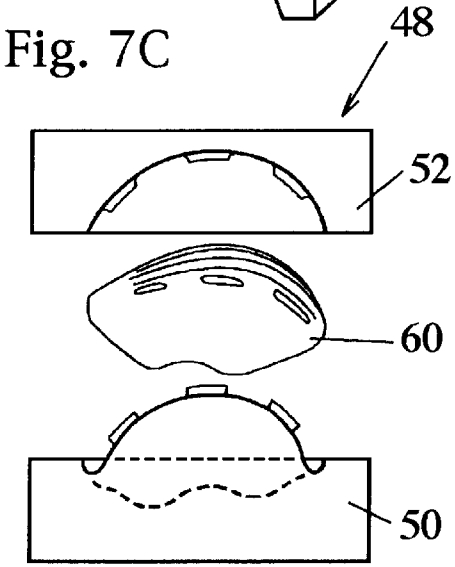
Fig. 7F
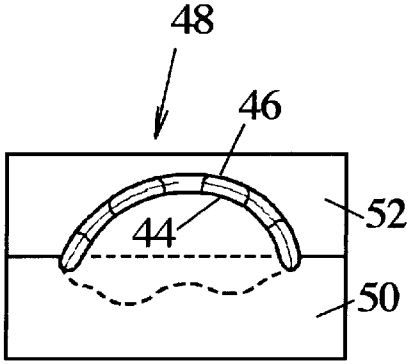
Fig. 7E
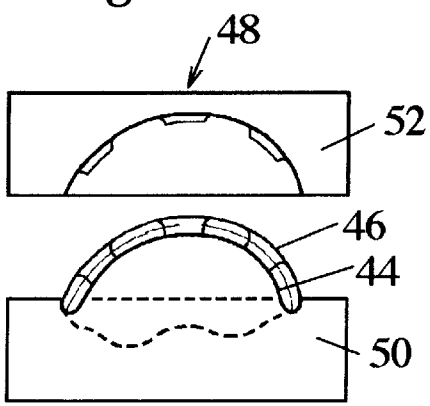
Fig. 7D
Fig. 7

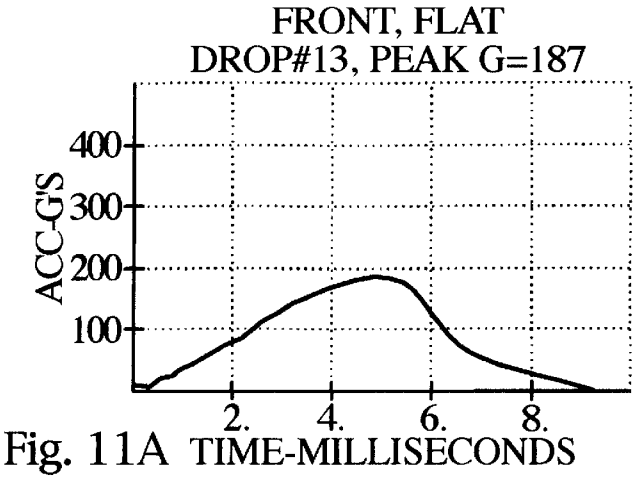
Fig. 11A
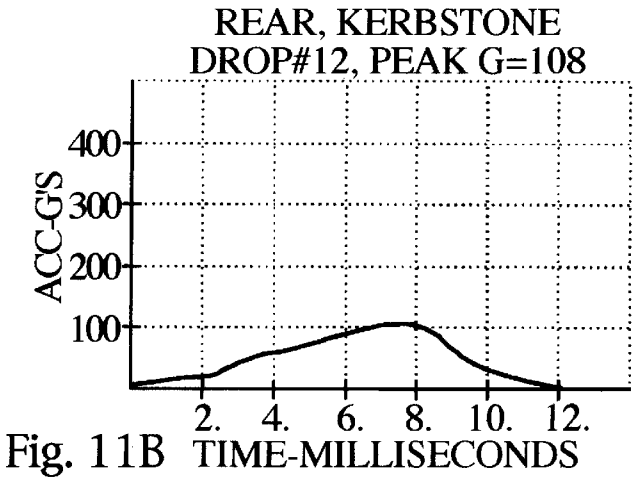
Fig. 11B
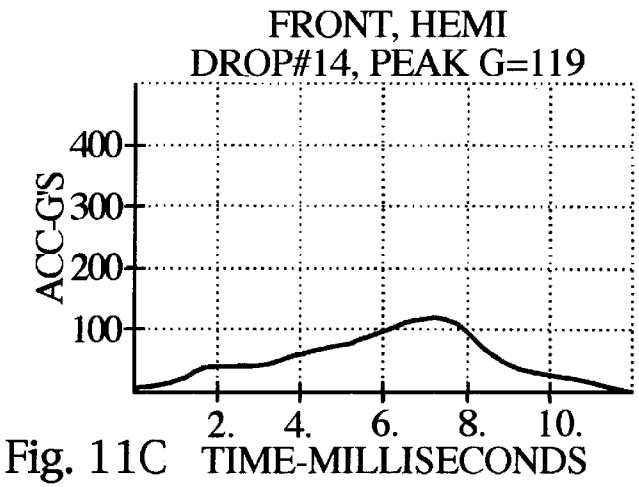
Fig. 11C
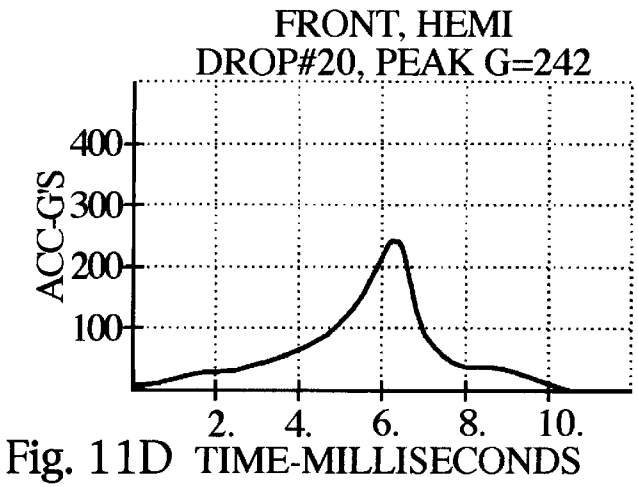
Fig. 11D
Fig. 11

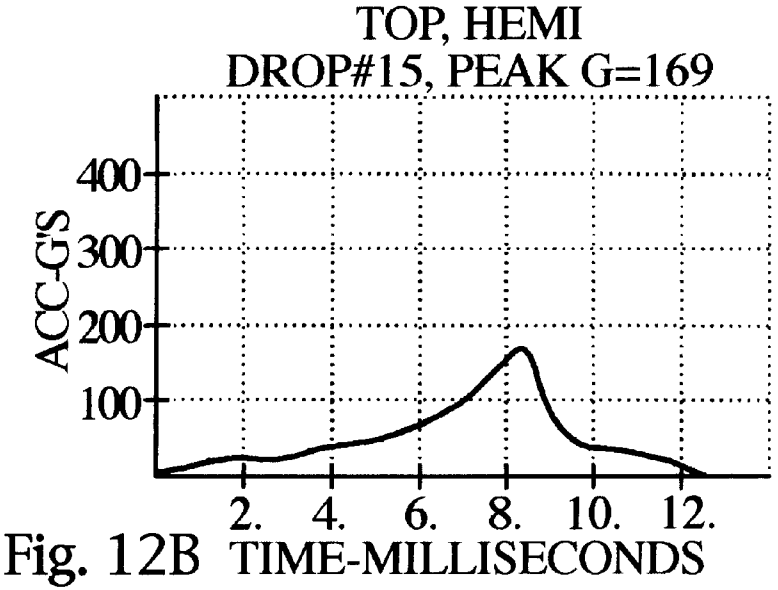
Fig. 12B
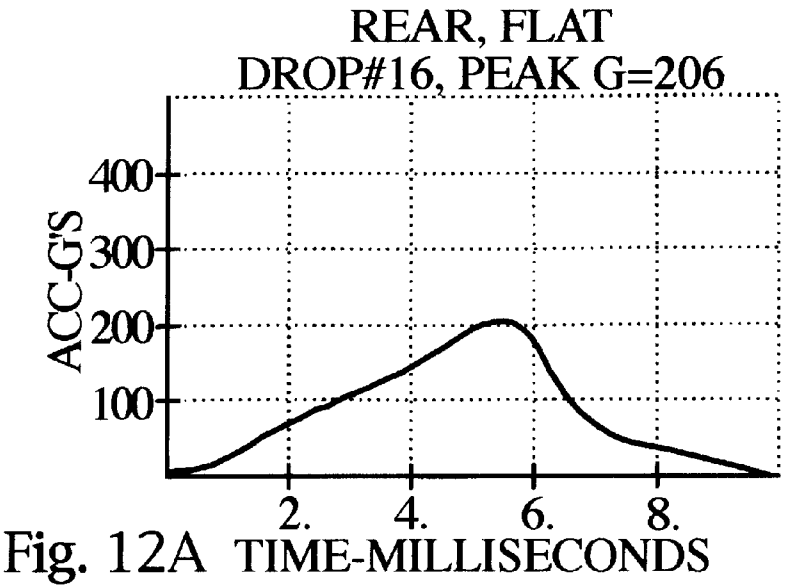
Fig. 12A
Fig. 12

PROTECTIVE HELMET

FIELD OF THE INVENTION

The present invention relates generally to protective helmets for protecting a wearer's head from impacts, and particularly to protective helmets for use while participating in sports, such as bicycling, horseback riding, windsurfing, skateboarding or roller skating.

BACKGROUND OF THE INVENTION

Head injury is a leading cause of accidental death and disability among children in the United States, resulting in over 100,000 hospitalizations every year. Studies have shown that children under the age of 14 are more likely to sustain head injuries than adults, and that children's head injuries are often more severe than those sustained by adults. In general, head injuries fall into two main categories—focal and diffuse. Focal injuries are limited to the area of impact, and include contusions, hematomas, lacerations and fractures. Diffuse brain injuries involve trauma to the neural and vascular elements of the brain at the microscopic level. The effect of such diffuse damage may vary from a completely reversible injury, such as a mild concussion, to prolonged coma and death.

Based on data from CPSC's National Electronic Injury Surveillance System (NEISS) an estimated 606,000 bicycle-related injuries were treated in U.S. hospital emergency rooms in 1994. In addition, about 1000 bicycle-related fatalities occur each year, according to the National Safety Council. A Consumer Product Safety Commission study of bicycle use and hazard patterns in 1993 indicated that almost one-third of bicycle injuries involve the head. Published data indicate that, in recent years, two-thirds of all bicycle-related deaths involved head injuries. Younger children are at particular risk for head injury. The Commission's data indicate that the injury risk for children under 15 was over 5 times the risk for older riders. About one-half of the bicycle-related injuries to children under age 10 involved head injuries, compared to about one-fifth of injuries to older riders. Children were also less likely to have been wearing a helmet at the time of a bicycle-related incident than were adults. The Commission's Bicycle Use Study found that about 18 percent of bicyclists wear helmets. Research has shown that helmets may reduce the risk of head injury to bicyclist by 85 percent, and the risk of brain injury by about 88 percent. Impact attenuation is one of the most important characteristics of a protective helmets for avoiding head injury.

Other activities, such as roller skating, in-line skating and skate boarding are typically conducted on the same types of surfaces as bicycling and can generate speeds similar to bicycling. Therefore, similar patterns of injury and benefits of helmet usage can be expected. Similar design considerations would apply for protective helmets for skating activities, in terms of impact attenuation. One difference between bicycling injuries and skating injuries is that, while 90 percent of bicycle-related head injuries occur on the front of the head, 80 percent of skating-related head injuries occur on the back of the head. Consequently, protective helmets for skating activities may have somewhat different design considerations in terms of coverage and location of protective padding. Protective helmets for aquatic activities, such as windsurfing, kayaking or waterskiing, have similar design considerations in terms of impact attenuation, with the additional requirement for moisture resistance during long-term immersion. Protective helmets for some activities, such as skiing or mountaineering, in addition to impact attenuation, have a need for a broad range of service temperatures.

The Children's Bicycle Helmet Safety Act of 1994 was signed into law in the U.S. on Jun. 16, 1994. Section 16 CFR 1203.3 of the proposed rule published pursuant to this act provides that bicycle helmets manufactured after Mar. 15, 1995 must conform to one of the following interim safety standards: The American National Standards Institute (ANSI) standard Z90.4-1984, the Snell Memorial Foundation standard B-90, B-90S, N-94 or B-95, the American Society for Testing and Materials (ASTM) F 1447, or Canadian Standards Association standard CAN/CSA-D113.2-M89. A revised proposed version of rule 16 CFR 1203 by the Consumer Product Safety Commission was published in the Federal Register on Dec. 6, 1995. The standard in proposed rule 16 CFR 1203 and each of the designated interim standards are incorporated herein by reference.

Integral to the proposed standard and each of the interim standards is a test for impact attenuation. The test measures the ability of the helmet to protect the head in a collision by securing the helmet on a headform with a weight of 5 kg for adult helmets or 3.9 kg for children's helmets and dropping the helmet/headform assembly from specified heights onto a fixed steel anvil. Three types of anvils are used for the test (flat, hemispherical, and "curbstone") representing types of surfaces encountered in actual riding conditions. Instrumentation within the headform records the acceleration during the headform's impact with the anvil in units of multiples of the acceleration due to gravity ("g"). Impact tests are performed on different helmets, each of which has been subjected to different environmental conditions. These environments are: ambient (room temperature), high temperature (117–127 ° F.), low temperature (3–9° F.), and immersion in water for 4–24 hours.

Impacts are specified on a flat anvil from a height of 2 meters and on hemispherical and curbstone anvils from a height of 1.2 meters. In order for a helmet to be certified, the peak headform acceleration of any impact must not exceed 300 g under these test conditions. (An accepted industry standard is that test results of under 270 g allows sufficient safety margin to account for variations in the manufacturing of the helmets.)

Section 1203.11 of the proposed rule specifies the procedure for defining the area of the helmet that must provide impact protection. The original proposed rule also included an additional impact duration requirement that was eliminated from the revised standards, specifying maximum time limits of 6 milliseconds and 3 milliseconds are set for the allowable duration of the impact at the 150 g and 200 g levels, respectively. Some of the voluntary standards, e.g. Snell N-94, also provide for testing for multiple impacts at a single location on the helmet, but this requirement has not been included in the proposed standard.

Nearly one hundred percent of the protective helmets for bicycling currently on the market use expanded polystyrene foam (EPS) as a helmet liner to meet the impact attenuation requirements of the safety standards. The popularity of EPS as a protective helmet or helmet liner is due to a combination of multiple factors, including its impact attenuation capability, low cost, ease of manufacturing and light weight. However, EPS has a number of drawbacks as a protective helmet liner as well. The mechanism of impact attenuation exhibited by EPS, while highly effective, causes permanent and irreversible damage to the EPS material. The EPS material does not recover significantly after a serious impact, so that repeated impacts at the same location on the helmet do not receive the same degree of impact attenuation. This is not considered a serious drawback by many because, in accident sequences it is rarely observed that a helmet suffers two blows on the same site. Usually, the complex motions of the body during an accident mean that blows occur at different locations. What is considered a more serious problem is the deteriorated impact attenuation performance of the helmet in another accident at a later date.

Because the process of impact attenuation is destructive to the EPS helmet or helmet liner, manufacturers of EPS bicycle helmets recommend destroying and replacing the protective helmet after any serious impact or returning the helmet to the manufacturer. This recommendation is also reflected in the product labeling requirements of the proposed standards. This recommendation, if complied with, would help to assure proper head protection for bicycle riders. However, compliance by the consumer is voluntary, and many consumers, particularly children, may be reluctant to discard a helmet that appears to still be operative even though it has reduced impact attenuation. In addition, even relatively minor impacts to a helmet can cause microscopic cracks in the EPS material which can seriously deteriorate the impact attenuation performance of the helmet. Such damage can occur when the helmet is dropped or when something heavy is stacked on top of it in the trunk of a car. One of the characteristics of EPS that makes it prone to this kind of damage is that it has extremely low tensile strength. Any loading which places the EPS helmet or helmet liner in tension or bending is likely to cause damage to the EPS material that might compromise its impact attenuation properties. The lack of tensile strength in the EPS material also limits its usefulness for full coverage or wrap-around style helmets. Full coverage or wrap-around style helmets using EPS as an impact attenuation material must have an additional hard shell to support tensile or bending stresses that would damage the EPS helmet liner.

Environmental conditions can also deteriorate the impact attenuation performance of an EPS protective helmet. Moisture can penetrate the cell structure of the EPS material and deleteriously affect the protective performance of the helmet. Moisture exposure can happen from wearing the protective helmet while riding in the rain or even from the perspiration of the rider. Moisture sensitivity is a particular problem in helmets for use in aquatic activities, such as windsurfing, kayaking or waterskiing, where the helmet may be subject to repeated or prolonged immersion in water. High temperatures can also deteriorate the impact attenuation performance of an EPS protective helmet. Temperatures in a closed automobile in the summertime can sometimes exceed 130° F. At these elevated temperatures, molding stresses from the EPS manufacturing process may warp the helmet and render it unusable. In addition, residual chemical blowing agents in the EPS may become reactive at elevated temperatures causing changes to the cell structure of the material which may affect its impact attenuation.

Another aspect of using EPS as an impact attenuation material in protective helmets is that the current safety standards may reflect the maximum protective performance possible from this material. Historically, the impact attenuation performance of EPS helmets has had to be improved to meet escalating safety standards based on public awareness of the need for better safety protection. In 1985, to conform with the Snell standards for impact attenuation, protective helmet liners were made with EPS material having a density of 4.5 to 5 pounds per cubic foot (pcf). In 1990, when the safety standards were raised, EPS material with a density of 5.5 to 6 pcf was needed to meet Snell standards for impact attenuation. Since adoption of the current safety standard, manufacturers have had to develop EPS materials with a density of 6.5 to 7 pcf to meet the new impact attenuation requirements. The newer, higher density EPS materials are harder to manufacture and further increases in the density may make the EPS too solid to be effective as an impact attenuation material. In addition, the nature of the EPS molding process precludes the possibility of manufacturing a dual density, laminated helmet of EPS. Current standards may represent the ultimate safety protection possible from EPS materials. Tightening safety standards in the future may actually exclude EPS as an impact attenuation material for protective helmets. To make further improvements in safety standards possible, new materials and construction methods for protective helmets will be needed.

SUMMARY OF THE INVENTION

In order to meet current and future safety standards for protective helmets for bicycling and other sports and to overcome the inherent drawbacks of the prior art EPS helmets, the present invention provides a protective helmet with a shell made of a laminated, dual density, closed-cell, foamed polymeric material. An inner layer of the helmet is made of a closed-cell, foamed polymeric material with a relatively low density for comfort, for absorption of minor impacts and for distributing the stress of a major impact over a larger surface of the wearer's skull to lessen the likelihood of injury. An outer layer of the helmet is made of a closed-cell, foamed polymeric material with a higher density for absorption of major impacts to the helmet and for providing a structurally stable shell to the helmet. Intermediate layers may be included between the inner and outer layers. Additional pads may be added to the inside surface of the helmet for customizing the fit and for spacing the helmet away from the wearer's head for ventilation. Ventilation holes through the laminated helmet shell provide airflow through the helmet. The helmet shell may also be provided with holes or other attachment means for attachment of a retention system for fastening the helmet on the rider's head.

The preferred material for both the inner and outer layers of the laminated, dual density protective helmet is a nitrogen blown, cross-linked, closed-cell, high-density polyethylene foam. In one particularly preferred embodiment, the inner layer of the helmet is made of polyethylene foam with a density of approximately 5 pcf and the outer layer is made of polyethylene foam with a density of approximately 7.2 pcf. In a second particularly preferred embodiment, the inner layer of the helmet is made of polyethylene foam with a density of approximately 3.8 pcf and the outer layer is made of polyethylene foam with a density of approximately 5 pcf. The high-density polyethylene foam selected for the helmet construction provides particularly advantageous material properties which cannot be realized with prior art EPS helmet materials.

The nitrogen blown, cross-linked, closed-cell, high-density polyethylene foam laminate used in the helmet of the present invention provides greater impact attenuation than does EPS. The superior impact attenuation properties of the laminate allow a helmet that meets current safety standards to be made with a total thickness between approximately 26 and 36 mm. This potentially reduces the weight of the protective helmet to under 8 ounces, which improves comfort and reduces neck fatigue for the wearer. Improving the comfort of the helmet increases the likelihood that the helmet will be used, especially by children for whom the safety protection aspect may not be sufficient inducement to wear an uncomfortable helmet.

The polyethylene foam laminate also exhibits much better recovery behavior than do the EPS helmet materials of the prior art. Recovery of the polyethylene foam material after minor impacts to the helmet is immediate and complete. Minor impacts do not measurably deteriorate the impact attenuation properties of the helmet. The polyethylene foam material also exhibits a significant amount of recover after major impacts to the helmet. Within 24 hours after a major impact to the helmet, consistent with a bicycle accident that would otherwise have resulted in serious head injury to the rider, the polyethylene foam helmet material recovers to the point that the impact attenuation performance for a second impact at the same site on the helmet is approximately 70 percent of the original impact attenuation value. After repeated impacts at the same site on the helmet, the impact attenuation performance of the polyethylene foam material is still approximately 50 percent of the original impact attenuation value and does not diminish any further. This repeat impact attenuation performance is far superior to current EPS helmet materials. The implication of this is that a helmet constructed according to the present invention will still provide a significant amount of head protection to the wearer even after repeated impacts. Using the teachings of the present invention, a helmet has been designed so that even after repeated impacts, the helmet still meets current safety standards for new helmets.

The nitrogen blown, cross-linked, closed-cell, high-density polyethylene foam laminate also provides superior resistance to environmental factors. The polyethylene foam material is essentially impervious to water, so it is immune to degradation from exposure to moisture, even after immersion in water for extended periods. Because the polyethylene foam material is cross-linked and because it is blown with pure gaseous nitrogen, is also highly stable over an extended temperature range. The operating temperature range of the polyethylene foam material is from approximately −95° F. to 250° F., which far exceeds the comfortable operating temperature range of the rider. The polyethylene foam material also has significant tensile strength, which allows it to be fashioned into extended coverage, full coverage or wrap-around style helmets without the need for an additional hard shell or other supporting structure. The combined properties of high tensile strength and recovery after impact or deformation makes the helmet highly resistant to damage from rough handling, such as when a heavy object is accidentally placed on top of it.

The method of manufacture which is part of the present invention is a low pressure compression molding process which simultaneously shapes the protective helmet and laminates the inner and outer layers of the helmet shell. The method allows efficient manufacture of the protective helmet at a cost which is competitive with prior art EPS helmets despite the lower raw material costs of the EPS material in today's market.

BRIEF DESCRIPTION OF THE DRAWINGS

FIG. 7 is a schematic representation of the protective helmet manufacturing method of the present invention with the steps of the manufacturing process designated by the letters A through F.

FIGS. 11A–11D are graphs of typical safety testing data for a protective helmet of a laminated, dual density, closed-cell, foamed polymeric material.

FIGS. 12A–12B are graphs of typical safety testing data for a protective helmet of a laminated, uniform density, closed-cell, foamed polymeric material.

DETAILED DESCRIPTION OF THE INVENTION

Figure 1:
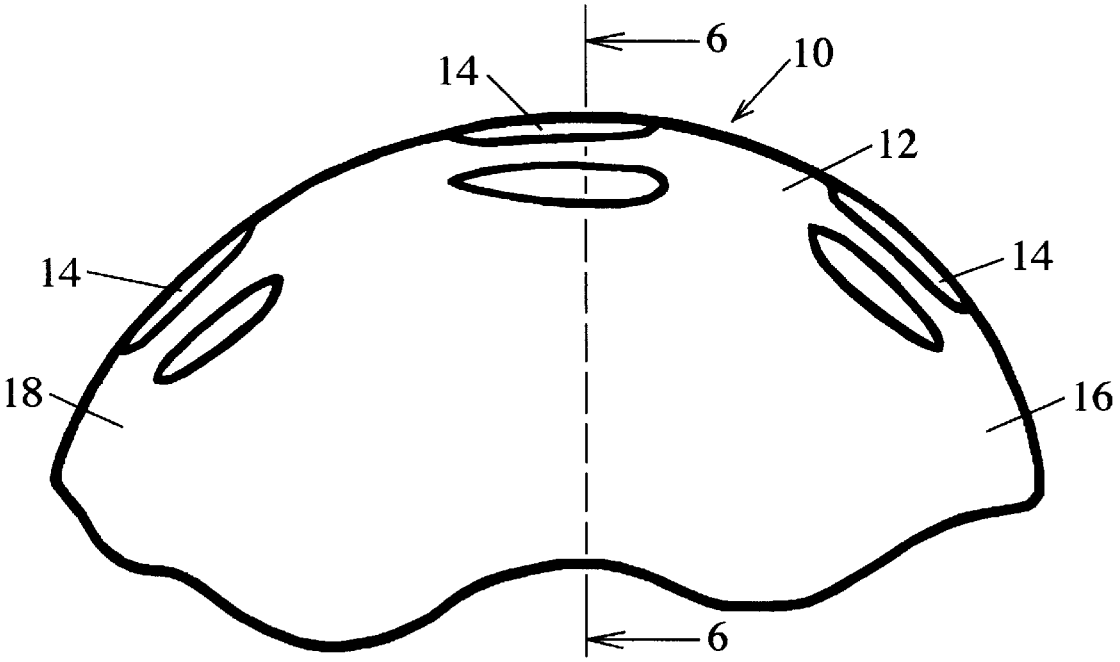
FIG. 1 is an exterior right side view of a protective helmet constructed in accordance with the present invention.
Figure 2:
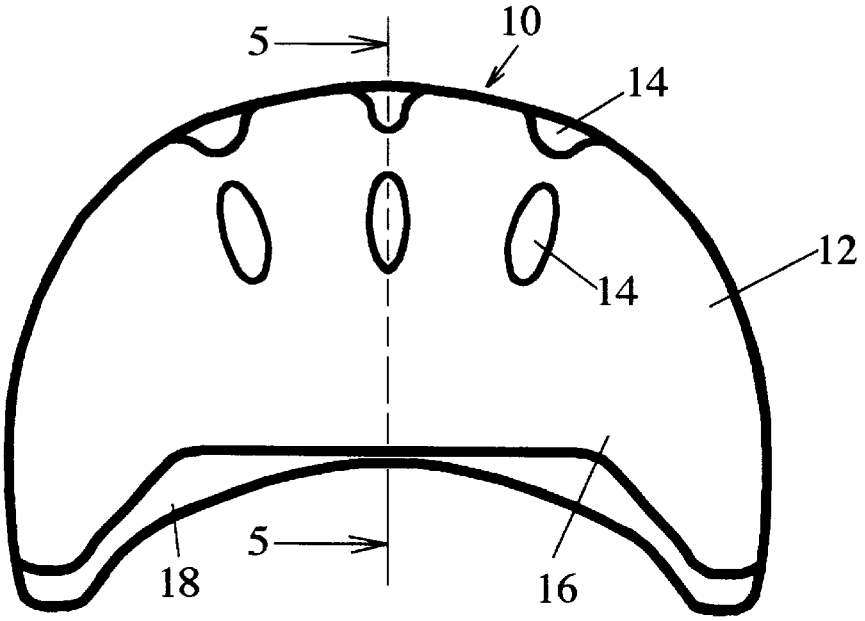
FIG. 2 is an exterior front view of the protective helmet of FIG. 1.
Figure 3:
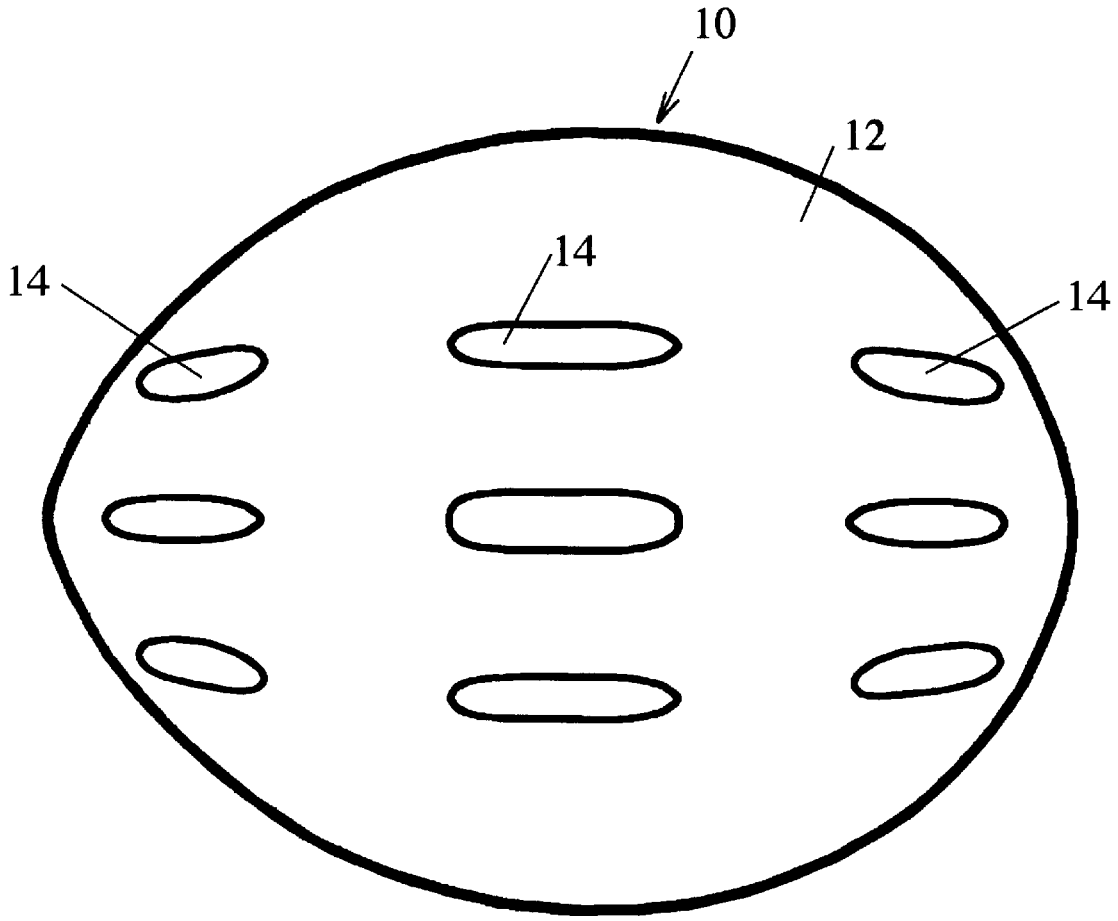
FIG. 3 is a top view of the protective helmet of FIG. 1.
Figure 4:
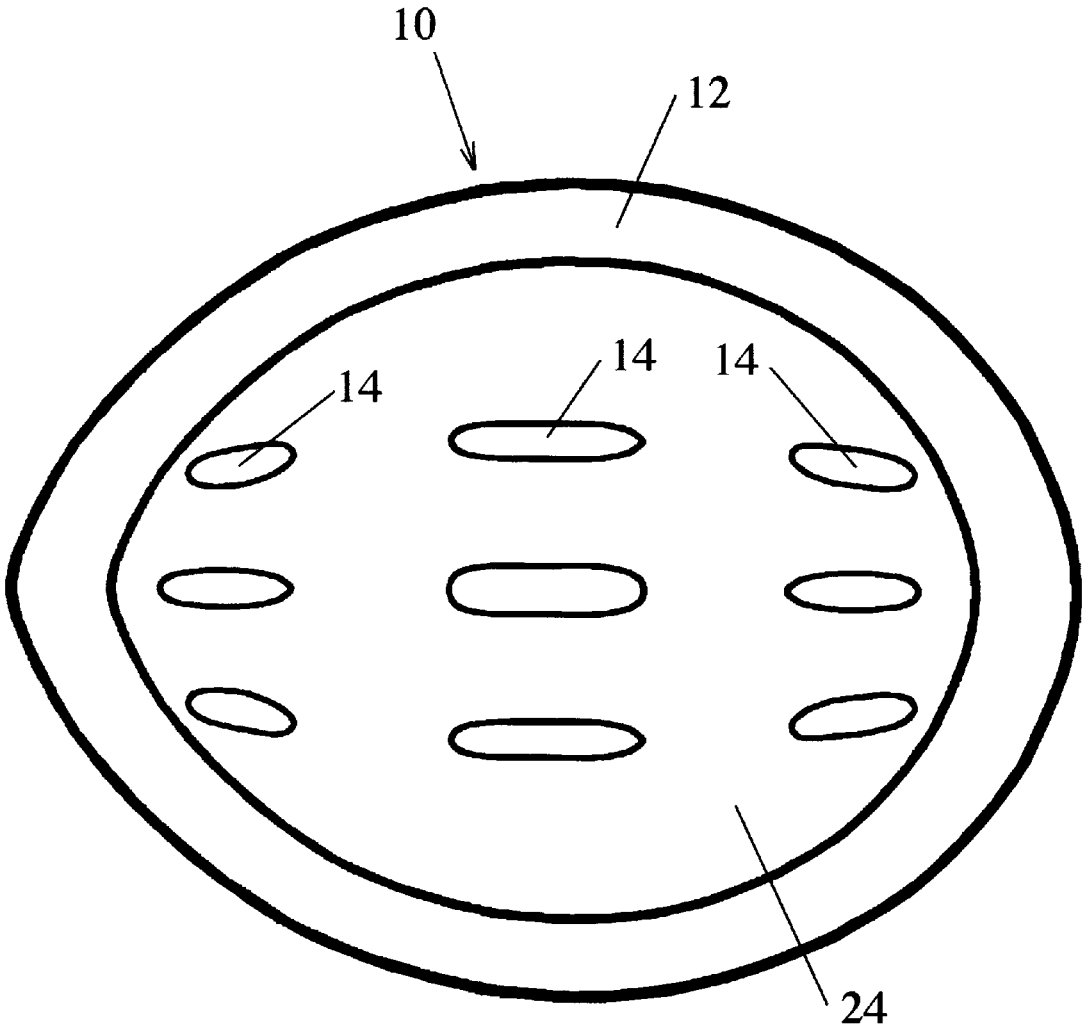
FIG. 4 is a bottom or interior view of the protective helmet of FIG. 1.

FIG. 1 is an exterior right side view of a protective helmet 10 for bicycle riders constructed in accordance with the present invention. FIG. 2 is an exterior front view of the protective helmet 10 of FIG. 1. FIG. 3 is a top view of the protective helmet 10 of FIG. 1. FIG. 4 is a bottom view showing the interior of the protective helmet 10 of FIG. 1. The protective helmet 10 is preferably made with a streamlined aerodynamic shape, such as the one shown in this illustrative example. The helmet 10 has ventilation holes 14 in the front 16 and back 18 of the helmet 10 to allow cooling air to circulate through the helmet 10. The helmet 10 may also include a chin strap or other retention system (not shown) for fastening the helmet 10 on the rider's head. In keeping with the proposed CPSC standards in 16 CFR 1203, the helmet 10 is designed so that it provides the wearer with unobstructed peripheral vision to at least 105° on each side of the midsagittal plane and with protective coverage on at least the front, side and top portions of the head as defined in section 1203.11(b)(1) for adults. Protective bicycle helmets for children under 5 years of age will provide increased protective coverage on the front, side, top and back portions of the head as defined in section 1203.11(b)(2). When intended for use in other sports, such as roller skating, in-line skating and skate boarding, the helmet 10 can be designed with increased protective coverage on the back of the head consistent with the head injury patterns observed for those sports.

Figure 5:
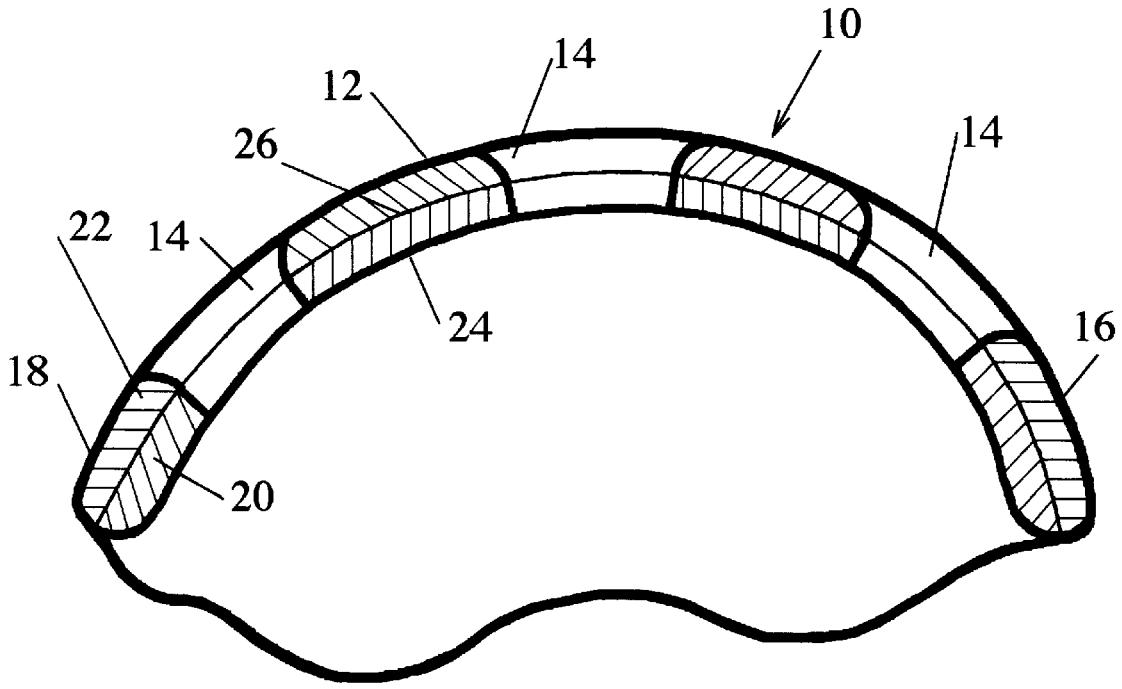
FIG. 5 shows a longitudinal cross section of the helmet of FIG. 1 taken along line 5—5 in FIG. 2.
Figure 6:
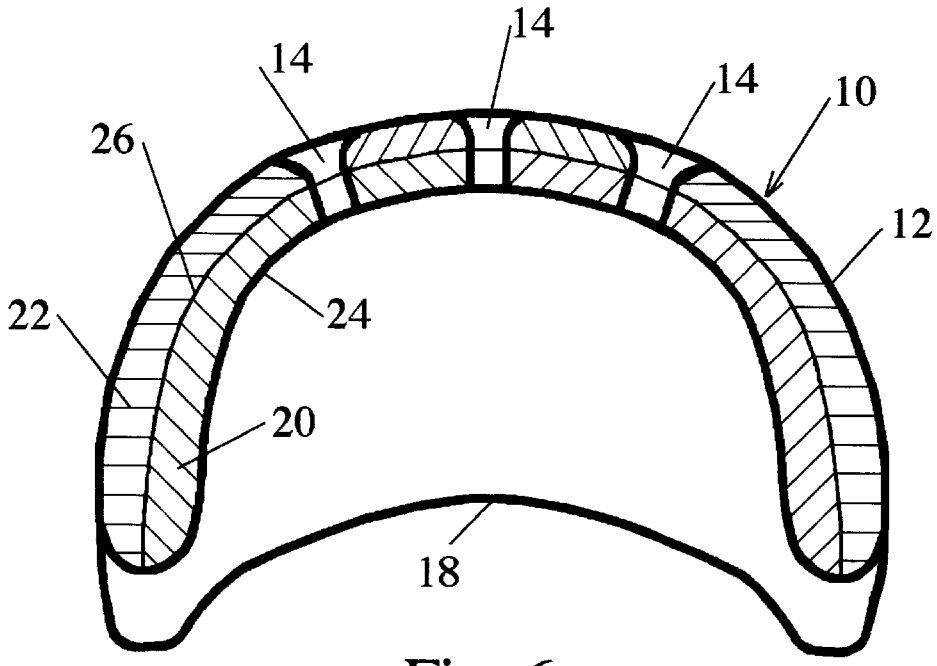
FIG. 6 shows a lateral cross section of the helmet taken along line 6—6 in FIG. 1.

In a preferred embodiment, the protective helmet 10 of the present invention has a helmet shell 12 made of a laminated, dual density, closed-cell, foamed polymeric material. FIG. 5 shows a longitudinal cross section of the helmet 10 taken along line 5—5 in FIG. 2. FIG. 6 shows a lateral cross section of the helmet 10 taken along line 6—6 in FIG. 1. An inner layer 20 of the helmet 10 is made of a closed-cell, foamed polymeric material with a relatively low density in the range of approximately 60 to 115 kg $m^{-3}$ (3.8 to 7.2 pounds per cubic foot), and preferably in the range of 60 to 80 kg $m^{-3}$, for comfort, for absorption of minor impacts and for distributing the stress of a major impact over a larger surface of the wearer's skull to lessen the likelihood of injury. An outer layer 22 of the helmet 10 is made of a closed-cell, foamed polymeric material with a higher density in the range of approximately 60 to 115 kg $m^{-3}$ (3.8 to 7.2 pounds per cubic foot), and preferably in the range of 80 to 115 kg $m^{-3}$, for absorption of major impacts to the helmet 10 and for providing a rigid structurally stable shell to the helmet 10. The inner layer 20 and the outer layer 22 of the helmet 10 are preferably made with a thickness in the range of approximately 10 to 20 mm. The overall thickness of the laminate is preferably in the range of approximately 20 to 40 mm, most preferably in the range of approximately 26 to 36 mm In one particularly preferred embodiment, the inner layer 20 and the outer layer 22 are made with approximately the same thickness, preferably in the range of approximately 13 to 18 mm. In a second particularly preferred embodiment, the inner layer 20 and the outer layer 22 are made with different thicknesses. For example, the protective helmet may be made with an outer layer 22 with a thickness of approximately 20 mm and an inner layer 20 with a thickness of approximately 10 mm, or vice versa. In alternate embodiments, the protective helmet may be made with multiple layers of impact absorbing, closed-cell, foamed polymeric material with two, three or more different densities. If desired, an adhesive or an adhesion promoter may be applied at the interface 26 between the inner 20 and outer 22 layers of the laminate to improve adhesion. Additional pads (not shown) may be added to the inside surface 24 of the helmet 10 for customizing the fit and for spacing the helmet 10 away from the wearer's head for ventilation. The additional pads may be made of a softer open-cell foam material for cushioning and comfort. These pads may be permanently attached to the interior of the helmet, for instance with adhesive, or may be adjustably or replaceably positioned by attaching them with hook-and-loop fasteners or similar repositionable fasteners. Ventilation holes 14 through the laminated helmet shell 12 provide airflow through the helmet 10. The helmet shell 12 may also be provided with holes or other attachment means for attaching a retention system to fasten the helmet 10 on the rider's head. Suitable retention systems for the protective helmet of the present invention are known in the prior art. Preferably, the polymeric foam material has sufficient tensile strength so that inserts or other reinforcements will not be necessary for attaching the retention system or other accessories, such as visors or mirrors, as they are with prior art EPS helmet materials.

The preferred material for both the inner 20 and outer 22 layers of the laminated, dual density protective helmet 10 is a nitrogen blown, cross-linked, closed-cell, high-density polyethylene foam. The term "high-density polyethylene" is used in its conventional sense here and throughout the specification to refer to a polyethylene material which in its non-foamed state has a density of approximately 0.94 g $cm^{-3}$ (940 kg $m^{-3}$) or greater. This term should not be confused with the bulk density or nominal density of the blown foam material referred to elsewhere in the specification. Suitable nitrogen blown, cross-linked, closed-cell, high-density polyethylene foam for this application is available as PLASTOZOTE® from Zotefoams Limited, 675 Mitcham Road, Croydon, Surrey, England. In one particularly preferred embodiment, the inner layer 20 of the helmet 10 is made of polyethylene foam with a nominal density of approximately 80 kg $m^{-3}$ (5.0 pcf) designated as HD 80 and the outer layer 22 is made of polyethylene foam with a nominal density of approximately 115 kg $m^{-3}$ (7.2 pcf) designated as HD 115. In a second particularly preferred embodiment, the inner layer 20 of the helmet 10 is made of polyethylene foam with a nominal density of approximately 60 kg $m^{-3}$ (3.8 pcf) designated as HD 60 and the outer layer 22 is made of polyethylene foam with a nominal density of approximately 80 kg $m^{-3}$ (5.0 pcf) designated as HD 80. In one specific embodiment of the invention, the protective helmet 10 is made with an outer layer 22 of 80 kg $m^{-3}$ density polyethylene foam with a thickness of approximately 20 mm and an inner layer 20 of 60 kg $m^{-3}$ density polyethylene foam with a thickness of approximately 10 mm. The high-density polyethylene foam selected for the helmet construction provides particularly advantageous material properties which cannot be realized with prior art EPS helmet materials.

The nitrogen blown, cross-linked, closed-cell, high-density polyethylene foam laminate used in the helmet 10 of the present invention provides greater impact attenuation than does EPS. The superior impact attenuation properties of the laminate allow a helmet that meets current safety standards to be made with a total thickness between approximately 28 and 36 mm. This potentially reduces the weight of the protective helmet 10 to under 8 ounces, which improves comfort and reduces neck fatigue for the wearer. Improving the comfort of the helmet increases the likelihood that the helmet will be used, especially by children for whom the safety protection aspect may not be sufficient inducement to wear an uncomfortable helmet.

The nitrogen blown, cross-linked, closed-cell, high-density polyethylene foam laminate of the helmet 10 also exhibits higher tensile strength than prior art EPS helmet materials. The HD 60 material has a tensile strength of approximately 315 psi, the HD 80 material has a tensile strength of approximately 330 psi and the HD 115 material has a tensile strength of approximately 400 psi. The compression strength of the HD 60 material is approximately 44 psi at 25 percent compression and approximately 56 psi at 50 percent compression. The compression strength of the HD 80 material is approximately 86 psi at 25 percent compression and approximately 93 psi at 50 percent compression. The compression strength of the HD 115 material is approximately 104 psi at 25 percent compression and approximately 129 psi at 50 percent compression. The tensile strength, the compression strength and the yield stress of these nitrogen blown, cross-linked, closed-cell, high-density polyethylene foam materials are also significantly higher than for other polyethylene foams formed by other processes, such as by chemical blowing. The improved mechanical properties of these materials makes them superior for application in a protective helmet than either the prior art EPS helmet materials or other known foam materials like chemically blown polyethylene foams. In particular, the higher yield stress of the nitrogen blown, cross-linked, closed-cell, high-density polyethylene foam results in superior impact attenuation performance compared to other impact absorbing foam materials.

The polyethylene foam laminate also exhibits much better recovery behavior than do the EPS helmet materials of the prior art. Recovery of the polyethylene foam material after minor impacts to the helmet is immediate and complete. Minor impacts do not measurably deteriorate the impact attenuation properties of the helmet. Within 24 hours after a major impact to the helmet, consistent with a bicycle accident that would otherwise have resulted in serious head injury to the rider, the polyethylene foam helmet material recovers to the point that the impact attenuation performance for a second impact at the same site on the helmet is approximately 70 percent of the original impact attenuation value. After repeated impacts at the same site on the helmet, the impact attenuation performance of the polyethylene foam material is still approximately 50 percent of the original impact attenuation value and does not diminish any farther. This repeat impact attenuation performance is far superior to current EPS helmet materials. The implication of this is that a helmet 10 constructed according to the present invention will still provide a significant amount of head protection to the wearer even after repeated impacts. By increasing the thickness of the high-density polyethylene foam laminate, the helmet 10 can be designed so that even after repeated impacts, the helmet still meets current safety standards for new helmets.

The nitrogen blown, cross-linked, closed-cell, high-density polyethylene foam laminate also provides superior resistance to environmental factors. The polyethylene foam material is essentially impervious to water, so it is immune to degradation from exposure to moisture, even after immersion in water for extended periods. Because the polyethylene foam material is cross-linked and because it is blown with pure gaseous nitrogen, an inert gas, it is also highly stable over an extended temperature range. The operating temperature range of the polyethylene foam material is from approximately −95° F. to 250° F. (approximately −70° C. to 120° C.). Other polyethylene foams, which are blown with chemical agents, such as azodicarbonamide, may become reactive at temperatures above 130° F. (54° C.), causing changes to the cell structure of the material which may affect its dimensional stability or impact attenuation. The polyethylene foam material also has significant tensile strength, which allows it to be fashioned into extended coverage, full coverage or wrap-around style helmets without the need for an additional hard shell or other supporting structure. The combined properties of high tensile strength and recovery after impact or deformation makes the helmet 10 highly resistant to damage from rough handling, such as when a heavy object is accidentally placed on top of it.

Another measure of the protection provided by a protective helmet is the impact energy absorption per unit volume of the impact-absorbing material. A method of measuring impact energy absorption per unit volume is described in "The Multiple-Impact Performance of High-Density Polyethylene Foam" by N. J. Mills and A.M.H. Hwang of the School of Metallurgy and Materials, University of Birmingham, England, published in *Cellular Polymers,* 9, 1989, p 259–276. This method involves impacting a sample of foam material of known dimensions with a striker mass dropped from a known height. The total energy prior to impact can be calculated from the mass of the striker and the height from which it is dropped or, alternatively, from the mass of the striker and the velocity at impact. An accelerometer measures and records the acceleration of the striker during the impact. A stress-strain curve of the impact is plotted based on the recorded acceleration data. The stress is calculated as the striker mass times the acceleration, divided by the area of the impact on the foam. The strain is calculated by numerically integrating the acceleration data from the point of impact once to obtain the striker velocity, then a second time to obtain the striker position and hence the (absolute) strain of the sample. The amount of energy absorbed per unit volume (in metric units of J $cm^{-3}$) of the foam material during the impact can be obtained by numerically integrating the area under the stress-strain curve.

Mills and Hwang define an impact energy absorption value or energy density value for the impact-absorbing foam material which is the amount of impact energy absorbed per unit volume of the foam (in units of J $cm^{-3}$) before an unsafe level of stress occurs. The safe limit for the stress was established at 2.5 MPa (2.5 $MNm^{-2}$) based on historical head injury data. The impact energy absorption value for the foam material is thus obtained by numerically integrating the area under the stress-strain curve below the 2.5 MPa line. The yield stress of the foam material and hence the impact energy absorption value increases with increasing density of the foam. The yield stress varies approximately with the 1.43 power of the density of the foam. The impact energy absorption value for a given impact-absorbing material can be correlated to the results of the helmet impact attenuation test in the proposed CPSC standards described above, either empirically by parallel testing or by calculation if the helmet and anvil geometry are known.

In repeated impact energy absorption testing, the nitrogen blown, cross-linked, closed-cell, high-density polyethylene foam laminate used in the helmet 10 of the present invention retains a significant percentage of its initial impact energy absorption value. When immediately subjected to a second impact at the same site without a recovery period, the high-density polyethylene foam laminate exhibits an unrecovered impact energy absorption value of approximately 55 percent of its initial impact energy absorption value. If the foam laminate is allowed to recover for 24 hours at 20° C., the recovered impact energy absorption value for a second impact at the same site is approximately 70 percent of the initial impact energy absorption value. The recovery period can be accelerated to 1 hour if the foam material is heated to 50° C. After being subjected to repeated impacts at the same site, the recovered impact energy absorption value of the polyethylene foam material after recovery is approximately 50 percent of the initial impact energy absorption value.

As described above, the three anvils in the impact attenuation testing of the proposed CPSC standards model the types of head impacts typical in a bicycle accident involving potential head injury. Due to the laminated geometry of the impact-absorbing helmet material and the nature of the impacts in a typical sporting accident, a helmet 10 constructed according to the present invention exhibits impact attenuation performance and impact energy absorption values equivalent to or better than a helmet made entirely from the higher density material of the outer layer 22. However, the weight of the helmet 10 is substantially less because the composite density of the laminate is approximately equal to a volumetric average of the densities of the higher density outer layer 22 and the lower density inner layer 20. The dual-density laminated helmet 10 exhibits better impact attenuation performance than a comparable weight helmet that is made entirely of a uniform foam material with a density equal to the average density of the two layers. Thus, the present invention provides a helmet that is lighter weight than the prior art and has greater safety protection. The lower weight improves the comfort of the helmet and reduces neck fatigue for the wearer. As mentioned above, improving the comfort of the helmet increases the likelihood that the helmet will be used, especially by children for whom the safety protection aspect may not be sufficient inducement to wear a helmet that is uncomfortable. This same effect can be achieved with a multiple-density protective helmet made by laminating three or more layers of polymeric foam material having different densities together, preferably with the highest density foam forming the outermost layer of the helmet. For example, the helmet shell 12 could be made with an inner layer of 60 kg $m^{-3}$ density polymeric foam, an intermediate layer of 80 kg $m^{-3}$ density polymeric foam, and an outer layer of 115 kg $m^{-3}$ density polymeric foam. Alternatively, the impact attenuation performance of the helmet 10 can be further improved by laminating an intermediate barrier layer of unfoamed material, for example an approximately 0.030 inch thick film of unfoamed 0.94 g $cm^{-3}$ density polyethylene, at the interface 26 between the inner 20 and outer 22 layers of the helmet 10. The use of a polyethylene barrier layer allows direct lamination between the inner layer 20, the outer layer 22, and the barrier layer of the helmet 10.

Although it is less preferred in a protective bicycle helmet, there are some circumstances in which it may be preferable to make the helmet 10 of the present invention with a lower density foam material forming the outer layer 22 of the laminate. Protective helmets for small children and protective helmets for use in certain medical settings, for example protective helmets for autistic patients, may be made with a lower density foam material forming the outer layer 22 of the helmet 10 or with an additional layer of lower density foam material over the dual-density foam laminate. The outer layer of lower density foam material would cushion minor impacts and would protect the surroundings as well as the wearer's head.

The improved impact attenuation properties of the protective helmet of the present invention have been confirmed in independent laboratory testing conducted at the Snell Memorial Foundation, West Coast Test Facility, North Highlands, Calif. FIGS. 11A–11D and 12A–12B illustrate representative results from safety tests conducted according to CPSC approved, Snell B-90 standards, which are explained in more detail above in the Background of the Invention section. More extensive test data, including testing of multiple samples of various helmet constructions are submitted herewith as an unpublished appendix to the patent application and are considered to be part of the original disclosure. FIGS. 11A–11D are graphs of representative safety testing data typical of results for a protective helmet of a laminated, dual density, closed-cell, foamed polymeric material. The embodiment of the helmet tested in FIGS. 11A–11D was constructed with an inner layer of HD 60 material with a thickness of approximately 10 mm and an outer layer of HD 80 material with a thickness of approximately 20 mm. FIG. 11A shows a graph of acceleration in G's versus time in milliseconds for an impact of a headform wearing the protective helmet with a flat anvil. The peak acceleration during the flat anvil test was 187 g. FIG. 11 is a graph of acceleration in G's versus time in milliseconds for an impact with a curbstone anvil. The peak acceleration during the curbstone anvil test was 108 g. FIG. 11C is a graph of acceleration in G's versus time in milliseconds for an impact with a hemispherical anvil. The peak acceleration during the hemispherical anvil test was 119 g. These test data are all significantly below the 300 g passing threshold for the CPSC testing standards, indicating a protective helmet with a high degree of protection from head injuries in an accident.

FIG. 11D shows a graph of a repeated hemispherical anvil test of the same laminated, dual density protective helmet. This test was conducted by striking the helmet a second time with the hemispherical anvil at the same site on the helmet as the test of FIG. 11C with about a one minute delay between impacts. In the appended test report this is termed an "illegal drop" because this very rigorous repeat impact test exceeds the recommended test standards for protective helmets. Even under these extremely rigorous test conditions, the laminated, dual density protective helmet of the present invention passes the test with a peak acceleration of 242 g. If the protective helmet had been allowed a 24 hour recovery period at room temperature between impacts, the peak acceleration in the second impact test would have been much closer to the result for the initial impact test. The implication of this is that for repeated accidents and even for repeated impacts at the same location on the helmet within the same accident sequence, the helmet of the present invention provides protection from head injury which exceeds the recommended safety standards for new bicycle helmets. Prior art EPS protective helmets do not provide this type of repeat impact protection.

FIGS. 12A–12B are graphs of representative safety testing data typical of results for a protective helmet of a laminated, uniform density, closed-cell, foamed polymeric material. The embodiment of the helmet tested in FIGS. 12A–12B was constructed with inner and outer layers of HD 80 material with a total thickness of approximately 30 mm. FIG. 12A shows a graph of acceleration in G's versus time in milliseconds for an impact of a headform wearing the protective helmet with a flat anvil. The peak acceleration during the flat anvil test was 206 g. FIG. 12B is a graph of acceleration in G's versus time in milliseconds for an impact with a hemispherical anvil. The peak acceleration during the hemispherical anvil test was 169 g. These test data are also well below the 300 g passing threshold for the CPSC testing standards, indicating a protective helmet with a high degree of protection from head injuries in an accident. However, a comparison of these data with the data of FIGS. 11A–11D shows the superior impact attenuation performance of the laminated, dual density helmet construction. On average, the laminated, dual density helmet transmitted approximately 33% lower g forces during impact than the uniform density helmet in the hemispherical and curbstone anvil tests and 11% lower g forces in the flat anvil test. In addition, the HD 60/HD 80 laminated, dual density helmet has a total weight with is approximately 8% less than the helmet made entirely of HD 80 material.

FIG. 7 is a schematic representation of the protective helmet manufacturing method of the present invention. The progressive stages of manufacture are designated by process steps A–F in FIG. 7. Step A of FIG. 7 shows the raw material for the laminated, dual-density protective helmet construction. The raw materials consist of a first master sheet 30 of closed-cell, polymeric foam material exhibiting the characteristics of resiliency and absorption of minor impacts and a second master sheet 32 of closed-cell, polymeric foam material exhibiting the characteristics of sufficient structural rigidity and impact attenuation of major impacts. In a preferred embodiment of the method, the first master sheet 30 is a sheet of nitrogen blown, cross-linked, closed-cell, high-density polyethylene foam having a density in the range of 60 to 115 kg $m^{-3}$ (3.8 to 7.2 pounds per cubic foot), and preferably in the range of approximately 60 to 80 kg $m^{-3}$. The first master sheet 30 preferably has a thickness in the range of approximately 10 to 20 mm. The second master sheet 32 in this preferred embodiment is a sheet of nitrogen blown, cross-linked, closed-cell, high-density polyethylene foam having a density in the range of approximately 60 to 115 kg $m^{-3}$ (3.8 to 7.2 pounds per cubic foot), and preferably in the range of 80 to 115 kg $m^{-3}$. The second master sheet 32 preferably has a thickness in the range of approximately 10 to 20 mm. The master sheets 30, 32 may have the same or different thicknesses, depending on the design of the helmet. The master sheets 30, 32 may be produced or purchased with the desired thicknesses, or thicker sheets may be cut to the desired thicknesses using a saw with a vibrating horizontal blade or other suitable cutting device. Alternatively, the master sheets 30, 32 may be made up of multiple thinner sheets of the polymeric foam materials that add up to the desired thicknesses. In an alternate embodiment of the method, multiple thin sheets of polymeric foam materials having three or more different densities that add up to the desired total thickness may be substituted for the dual density master sheets 30, 32 which are shown in step A of FIG. 7.

In step B of FIG. 7, the first 30 and second 32 master sheets are die cut into first 34 and second helmet 36 blanks. The shape of the first 34 and second helmet 36 blanks are determined by creating in flat form the profile of the three dimensional shape of the finished helmet 60. The second helmet blank 36, since it will become the exterior surface of the helmet 60, will likely be slightly larger in overall dimensions than the first helmet blank 34. Some trial and error may be necessary to determine the optimal shapes for the first 34 and second 36 helmet blanks. The ventilation holes 38, 40 or slots and any attachment holes necessary for the chosen retention system may also be made in the first 34 and second 36 helmet blanks at this time. In one preferred embodiment of the method, open ventilation holes 38 are cut into the first helmet blank 34 and narrow slots 40 are cut into the second helmet blank 36, which widen into open ventilation holes during the course of the molding process. Preferably, the first 34 and second 36 helmet blanks are die cut using steel rule dies. Alternatively, the first 34 and second 36 helmet blanks may be cut by hot wire, laser, water jet or other equivalent manufacturing methods.

In step C of FIG. 7, the cold first 34 and second 36 helmet blanks are individually loaded into a convection conveyor oven 42 which is temperature and speed controlled such that a optimally heated thermoformable hot first 44 and second 46 helmet blanks exit the oven 42 at approximately 150° C.

Immediately upon exiting the oven 42, the heated first helmet blank 44 and the heated second helmet blank 46 are sequentially hand loaded into individual molds 48 in the molding press as shown in step D of FIG. 7. The heated helmet blanks 44, 46 can be handled using thermal cotton gloves. The lower half 50 of each mold 48 is a positive mold of the interior shape of the helmet 60 which has vacuum hold down capabilities to hold the helmet blanks 44, 46 in position. The upper half 52 of the mold 52, which is a negative mold of the exterior shape of the helmet 60, is indexed closed to compression mold the heated helmet blanks 44, 46 to final shape, as shown in step E of FIG. 7. Permanent lamination of the first and second helmet blanks 44, 46 to one another occurs within the mold 48, simultaneously with the shaping of the helmet 60. If desired, an adhesive or an adhesion promoter may be applied to the first and second helmet blanks before or after the heating step to improve adhesion between the inner and outer layers of the laminate. Generally, the molded thickness of the finished helmet is approximately 10% less than the nominal thickness calculated by adding the raw material thicknesses of the component layers. The total thickness of the finished laminate is preferably between 26 and 36 mm. The mold temperature is then water cooled to 120° C., the mold 48 is opened and the finished helmet 60 is ejected from the mold 48 by reversing the hold down vacuum to positive pressure, as shown in step F of FIG. 7.

Small, medium and large molds are readily mounted or demounted in the molding press. Cycle time from cold blank to finished helmet is currently approximately 13–14 minutes.

Quality and density of the raw material is uniform within a very large batch and density can be verified by measuring and weighing master sheets in advance of production. Because of the low temperatures and pressures used in the molding process, the desirable characteristics of the closed-cell, polyethylene foam material are not significantly altered during manufacture of the helmet. The combination of temperature and pressure used also results in low molded-in stresses in the finished product so that the helmet is dimensionally stable, even at elevated operating temperatures.

Figure 8:
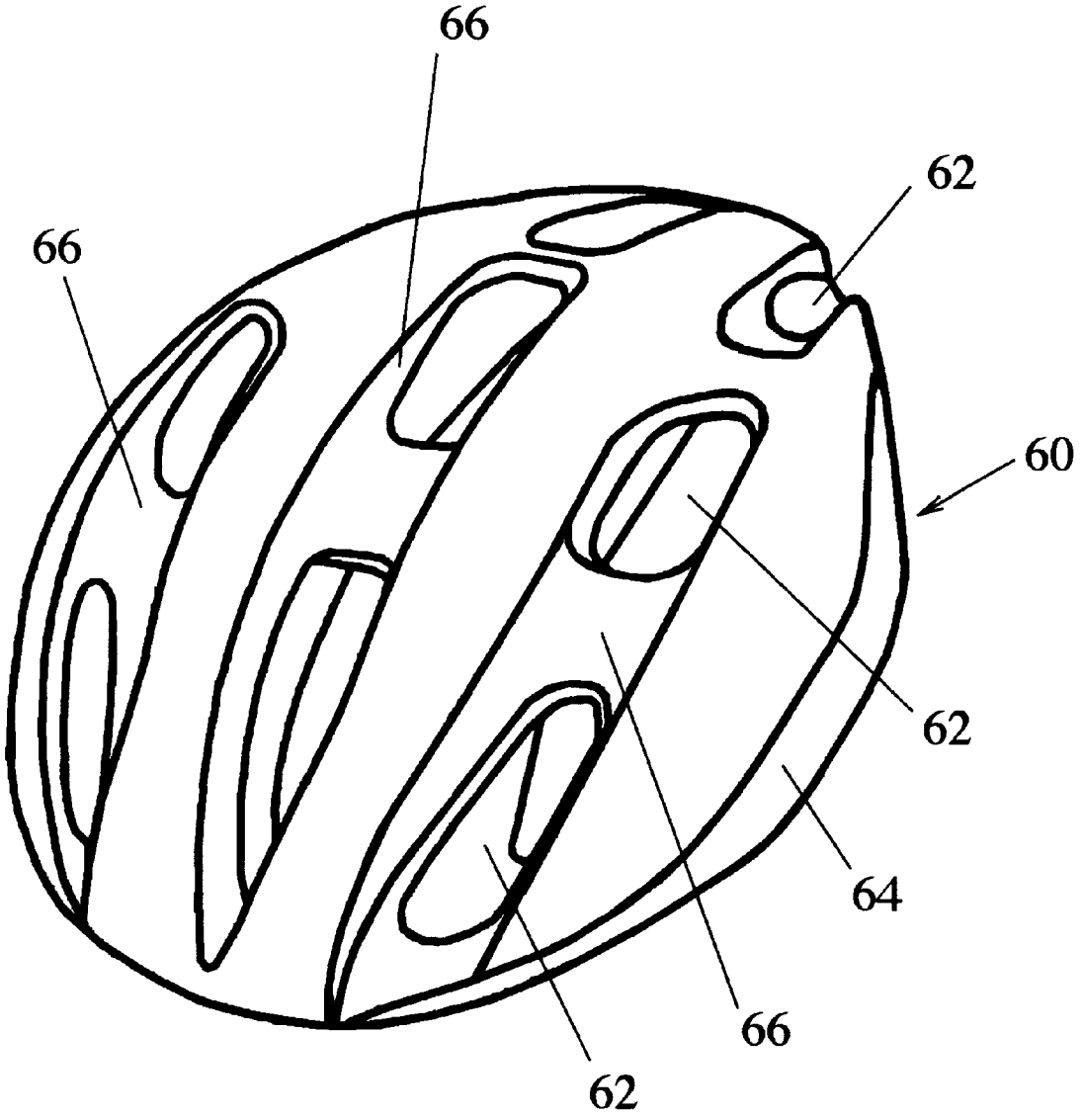
FIG. 8 is a front perspective view of a highly aerodynamic embodiment of the protective helmet of the present invention.
Figure 9:
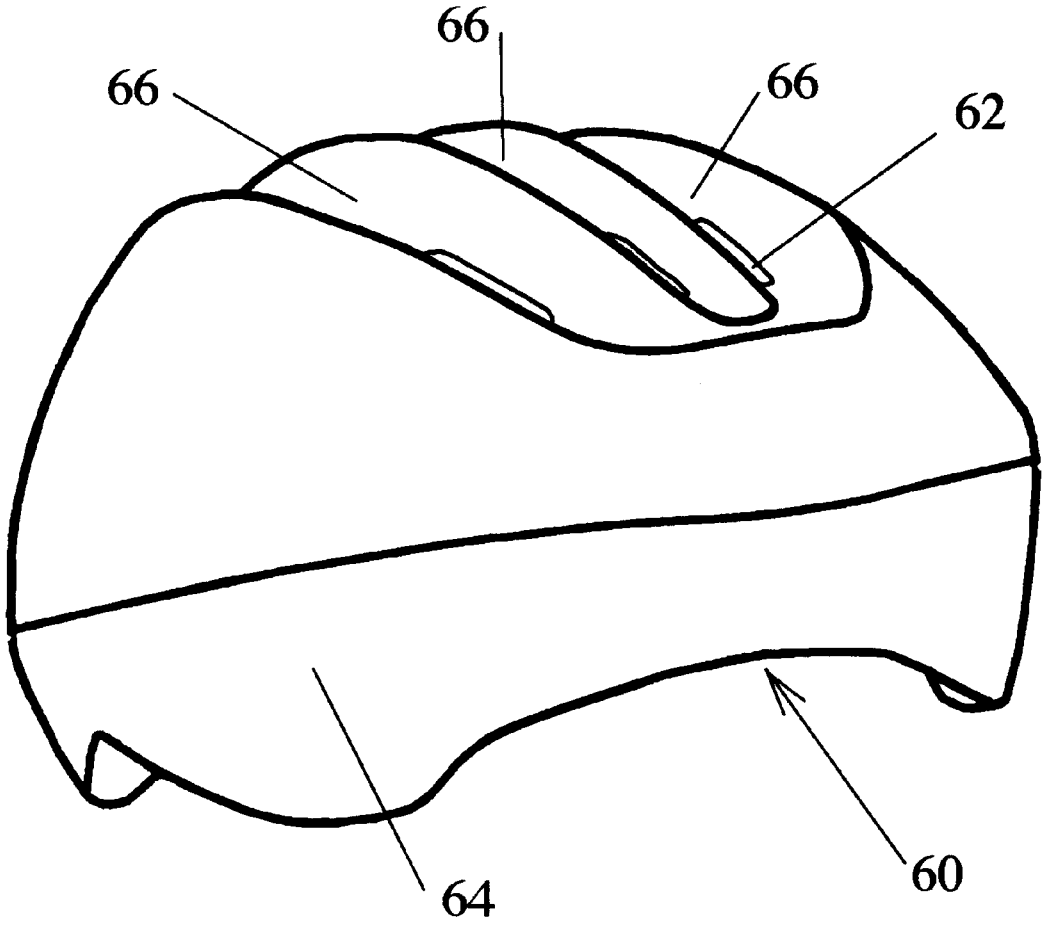
FIG. 9 is a rear perspective view of the highly aerodynamic protective helmet of FIG. 8.

FIG. 8 is a front perspective view of a highly aerodynamic embodiment of the protective helmet 60 of the present invention. FIG. 9 is a rear perspective view of the highly aerodynamic protective helmet 60 of FIG. 8. This highly aerodynamic embodiment of the invention demonstrates some of the advanced molding capabilities of the helmet manufacturing process described in connection with FIG. 7. In addition to the ventilation holes 62 previously described, this embodiment is molded with tapered contoured edges 64 and longitudinal aerodynamic grooves 66 which improve the ventilation, aerodynamics and the styling of the helmet design. The manufacturing process is also capable of producing other surface contours and features in the helmet 60 as desired. The closed-cell, polyethylene foam material used for constructing the dual-density foam laminate is commercially available in a wide range of decorative colors, including red, gold, blue, black, gray, silver, white, green, purple and orange. These colored foam materials can be used separately or in combination to add to the visual appeal of the finished helmet.

Figure 10:
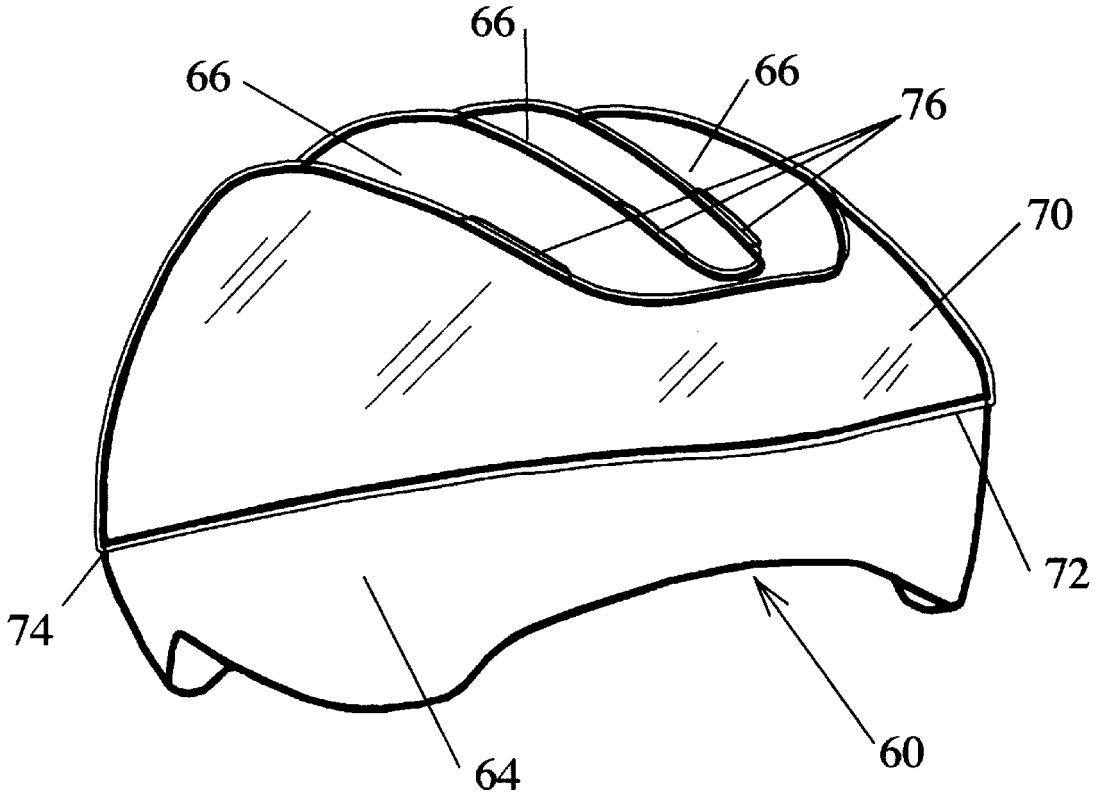
FIG. 10 shows the highly aerodynamic protective helmet of FIG. 8 accessorized with a removable decorative helmet cover.

The aesthetic appearance of the protective helmet of the present invention can be further enhanced with the addition of decorative accessories, such as a decorative helmet cover. Cloth or mesh covers, similar to those used for current EPS helmets, can be easily adapted to the protective helmet, as can cold weather helmet covers designed to reduce the ventilation airflow through the helmet. The construction of the protective helmet also lends itself to the addition of a molded decorative helmet cover which can be permanently or removably attached to the helmet. For example, FIG. 10 shows the highly aerodynamic protective helmet 60 of FIG. 8 accessorized with a removable decorative helmet cover 70. The removable decorative helmet cover 70 is preferably molded of a shatter resistant, thermoformable plastic, such as PETG copolyester, which can be molded to the desired shape. In one preferred embodiment, the removable decorative helmet cover 70 is shaped to cover the top portion of the helmet 60 and is contoured to follow the aerodynamic grooves 66 of the helmet 60. Generally, the removable decorative helmet cover 70 will also include cutouts 76 which correspond to the ventilation holes 62 of the helmet 60 (see FIG. 8). However, for cold weather use, the cutouts 76 may be reduced or eliminated entirely to decrease the ventilation airflow through the helmet 60.

To attach the removable decorative helmet cover 70, the protective helmet 60 is molded with an undercut groove 74 and the cover 70 is formed with a corresponding inwardly turned lip 72 which fits into the groove 74. The resiliency of the energy-absorbing, closed-cell, polymer foam material of the helmet 60 allows the helmet to be molded with undercuts or negative draft angles and still be easily removed from the mold without damage to the helmet. The resiliency of the helmet material also allows the removable decorative helmet cover 70 to be popped onto or off of the protective helmet 60 without damage to the helmet.

Alternatively, the removable decorative helmet cover 70 can be made to cover the entire exterior of the helmet 60 and the inwardly turned lip 72 can be formed to wrap around the contoured lower edge 64 of the helmet 60. The resiliency of the helmet material will allow the helmet 60 to be popped into the decorative helmet cover 70 and held in place by the undercut of the lip 72. The removable decorative helmet cover 70 can be made in a variety of opaque or transparent colors or patterns. Different helmet covers 70 can be interchanged to modify the appearance of the helmet 60. In one particularly preferred embodiment, the removable decorative helmet cover 70 is made of clear PETG copolyester, with a thickness of approximately 0.030 inches. The interior surface of the helmet cover 70 can be embellished with decals or other decorations so that they are visible through the clear plastic cover. Since the helmet cover 70 can be easily popped on and off of the helmet 60, the owner can customize or modify the appearance of the helmet whenever he or she desires.

Although the examples given include many specificities, they are intended as illustrative of only some of the possible embodiments of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

What is claimed is:

1. A protective helmet comprising:

a substantially uniform first layer of a first, energy-absorbing, closed-cell foam material having a first density in the range of approximately 3.8 to approximately 5 pounds per cubic foot, and a compression strength of at least approximately 40 pounds per square inch at 25 percent compression said first layer configured to cover a top of a user's head and at least a portion of a front, back, left and right sides of the user's head, and a substantially uniform second layer of a second, energy-absorbing, closed-cell foam material having a second density greater than said first density and in the range of approximately 5 to approximately 7.2 pounds per cubic foot, and a compression strength of at least approximately 40 pounds per square inch at 25 percent compression, said second layer configured to cover the top of the user's head and at least a portion of the front, back, left and right sides of the user's head.

2. The protective helmet of claim 1 wherein said first layer is an inner layer of said helmet and said second layer is an outer layer of said helmet.

3. The protective helmet of claim 3 wherein said first layer is approximately coextensive with said second layer.

4. The protective helmet of claim 1 wherein said second layer has a thickness of approximately 10 to 30 mm and said first layer has a thickness of approximately 10 to 30 mm.

5. The protective helmet of claim 2 wherein said first closed-cell foam material is a first cross-linked polyethylene foam and said second closed-cell foam material is a second cross-linked polyethylene foam.

6. The protective helmet of claim 5 wherein:

said protective helmet attenuates an impact of a headform of at least 3.9 kilograms dropped from a height of 2 meters onto a flat anvil with a peak impact acceleration that does not exceed 300 G, said protective helmet attenuates an impact of a headform of at least 3.9 kilograms dropped from a height of 1.2 meters onto a hemispherical anvil with a peak impact acceleration that does not exceed 300 G, and said protective helmet attenuates an impact of a headform of at least 3.9 kilograms dropped from a height of 2 meters onto a curbstone anvil with a peak impact acceleration that does not exceed 300 G.

7. The protective helmet of claim 6 wherein:

said protective helmet attenuates an impact of a headform of at least 5 kilograms dropped from a height of 2 meters onto a flat anvil with a peak impact acceleration that does not exceed 300 G, said protective helmet attenuates an impact of a headform of at least 5 kilograms dropped from a height of 1.2 meters onto a hemispherical anvil with a peak impact acceleration that does not exceed 300 G, and said protective helmet attenuates an impact of a headform of at least 5 kilograms dropped from a height of 2 meters onto a curbstone anvil with a peak impact acceleration that does not exceed 300 G.

8. The protective helmet of claim 7 wherein said protective helmet has a weight of less than approximately eight ounces.

9. The protective helmet of claim 5 wherein said first density of said first closed-cell foam material is approximately 3.8 pounds per cubic foot and said second density of said second closed-cell foam material is approximately 5 pounds per cubic foot.

10. The protective helmet of claim 5 wherein said first density of said first closed-cell foam material is approximately 5 pounds per cubic foot and said second density of said second closed-cell foam material is approximately 7.2 pounds per cubic foot.

11. The protective helmet of claim 1 wherein said first closed-cell foam material has a tensile strength of at least approximately 300 pounds per square inch.

12. The protective helmet of claim 1 wherein said first closed-cell foam material has a compression strength of at least approximately 50 pounds per square inch at 50 percent compression.

13. The protective helmet of claim 1 wherein said second closed-cell foam material has a tensile strength of at least approximately 330 pounds per square inch.

14. The protective helmet of claim 1 wherein said second closed-cell foam material has a compression strength of at least approximately 80 pounds per square inch at 25 percent compression.

15. The protective helmet of claim 1 wherein said second closed-cell foam material has a compression strength of at least approximately 90 pounds per square inch at 50 percent compression.

16. The protective helmet of claim 1 wherein the cells of said first closed-cell foam material are blown with an inert gas.

17. The protective helmet of claim 1 wherein the cells of said first closed-cell foam material are blown with nitrogen gas.

18. The protective helmet of claim 1 wherein the cells of said second closed-cell foam material are blown with an inert gas.

19. The protective helmet of claim 1 wherein the cells of said second closed-cell foam material are blown with nitrogen gas.

20. The protective helmet of claim 1 wherein said helmet has an initial energy absorption value for a first impact at a location on said helmet and a recovered energy absorption value for a second impact at the same location on said helmet which is at least approximately 70 percent of said initial energy absorption value.

21. The protective helmet of claim 1 wherein said helmet has an initial energy absorption value for a first impact at a location on said helmet and a recovered energy absorption value for multiple impacts at the same location on said helmet which is at least approximately 50 percent of said first energy absorption value.

22. The protective helmet of claim 1 wherein said helmet has an initial energy absorption value for a first impact at a location on said helmet and a recovered energy absorption value for a second impact at the same location on said helmet which is at least approximately 70 percent of said initial energy absorption value and a recovered energy absorption value for multiple impacts at the same location on said helmet which is at least approximately 50 percent of said initial energy absorption value.

23. The protective helmet of claim 1 wherein said helmet has an initial energy absorption value for a first impact at a location on said helmet and an unrecovered energy absorption value for a second impact at the same location on said helmet which is at least approximately 50 percent of said initial energy absorption value.

24. The protective helmet of claim 1 further comprising an intermediate layer of a polymeric material between said first layer and said second layer.

25. The protective helmet of claim 1 further comprising an intermediate layer of an unfoamed polymeric material between said first layer and said second layer.

26. The protective helmet of claim 1 further comprising a helmet cover having an inwardly turned lip which engages said second layer.

27. A protective helmet shell consisting essentially of:

an inner layer of a first, energy-absorbing, closed-cell foam material having a first density in the range of approximately 3.8 to approximately 5 pounds per cubic foot, and a compression strength of at least approximately 40 pounds per square inch at 25 percent compression, said inner layer configured to cover a top of a user's head and at least a portion of a front, back, left and right sides of the user's head, and an outer layer of a second, energy-absorbing, rigid, closed-cell foam material having a second density which is greater than said first density and is in the range of approximately 5 to approximately 7.2 pounds per cubic foot, and a compression strength of at least approximately 80 pounds per square inch at 25 percent compression, said outer layer configured to cover the top of the user's head and at least a portion of the front, back, left and right sides of the user's head.

28. The protective helmet shell of claim 27 wherein said first closed-cell foam material is a first nitrogen-blown, cross-linked, closed-cell, high-density polyethylene foam material and said second closed-cell foam material is a second nitrogen-blown, cross-linked, closed-cell, high-density polyethylene foam material.

29. The protective helmet shell of claim 27 wherein said first density of said first closed-cell foam material is approximately 3.8 pounds per cubic foot and said second density of said second closed-cell foam material is approximately 5 pounds per cubic foot.

30. The protective helmet shell of claim 27 wherein said first density of said first closed-cell foam material is approximately 5 pounds per cubic foot and said second density of said second closed-cell foam material is approximately 7.2 pounds per cubic foot.

31. A protective helmet comprising:

a first layer of a first, energy-absorbing, closed-cell foam material having a first density in the range of approximately 3.8 to approximately 5 pounds per cubic foot, and a second layer of a second, energy-absorbing, closed-cell foam material having a second density in the range of approximately 5 to approximately 7.2 pounds per cubic foot, wherein said second layer of energy-absorbing, closed-cell foam material has an undercut groove and an inwardly turned lip of a helmet cover engages said undercut groove.

32. The protective helmet of claim 31 wherein said helmet cover is removable from and replaceable on said second layer of an energy-absorbing, closed-cell foam material.

33. A multi-layered protective helmet comprising:

a first layer comprising:

an energy absorbing, closed-cell foam material having a first density in the range of between about 3.8 to about 5 pounds per cubic foot;

a tensile strength of at least about 300 pounds per square inch; and a compression strength of at least about 40 pounds per square inch at 25% compression; and a second layer comprising:

an energy absorbing, closed-cell foam material having a second density in the range of between about 5 to about 7.2 pounds per cubic foot;

a tensile strength of at least about 330 pounds per square inch; and a compression strength of at least about 80 pounds per square inch at 25% compression;

wherein said cells of said first and second layers are blown with an inert gas.

34. The protective helmet of claim 33 wherein said first layer is an inner layer of said helmet and said second layer is an outer layer of said helmet.

35. The protective helmet of claim 33 wherein said second layer has a thickness of approximately 10 to 30 mm and said first layer has a thickness of approximately 10 to 30 mm.

36. The protective helmet of claim 33 wherein said first closed-cell foam material is a first cross-linked polyethylene foam and said second closed-cell foam material is a second cross-linked polyethylene foam.

37. The protective helmet of claim 33 wherein said inert gas is nitrogen gas.

38. The protective helmet of claim 37 wherein said protective helmet is dimensionally stable at a temperature above approximately 130° F. (54° C.).

39. The protective helmet of claim 33 wherein said helmet has an initial energy absorption value for a first impact at a location on said helmet and a recovered energy absorption value for a second impact at the same location on said helmet which is at least approximately 70 percent of said initial energy absorption value.

40. The protective helmet of claim 33 wherein said helmet has an initial energy absorption value for a first impact at a location on said helmet and a recovered energy absorption value for multiple impacts at the same location on said helmet which is at least approximately 50 percent of said first energy absorption value.

41. The protective helmet of claim 33 wherein said helmet has an initial energy absorption value for a first impact at a location on said helmet and a recovered energy absorption value for a second impact at the same location on said helmet which is at least approximately 70 percent of said initial energy absorption value and a recovered energy absorption value for multiple impacts at the same location on said helmet which is at least approximately 50 percent of said initial energy absorption value.

42. The protective helmet of claim 33 wherein said helmet has an initial energy absorption value for a first impact at a location on said helmet and an unrecovered energy absorption value for a second impact at the same location on said helmet which is at least approximately 50 percent of said initial energy absorption value.

43. The protective helmet of claim 33 further comprising an intermediate layer of a polymeric material between said first layer and said second layer.

44. The protective helmet of claim 33 further comprising an intermediate layer of an unfoamed polymeric material between said first layer and said second layer.

45. The protective helmet of claim 33 further comprising a helmet cover having an inwardly turned lip which engages said second layer.

46. The protective helmet of claim 45 wherein said second layer of energy-absorbing, closed-cell foam material has an undercut groove and said inwardly turned lip of said helmet cover engages said undercut groove.

47. The protective helmet of claim 45 wherein said helmet cover is removable from and replaceable on said second layer of an energy-absorbing, closed-cell foam material.

* * * * *